United States Patent [19]

Buccicone

[11] 4,180,257

[45] Dec. 25, 1979

[54] MAGNETIC SHEET CONVEYOR

[75] Inventor: Dario Buccicone, Crown Point, Ind.

[73] Assignee: Bucciconi Engineering Co., Gary, Ind.

[21] Appl. No.: 873,372

[22] Filed: Jan. 30, 1978

[51] Int. Cl.[2] ..... B65H 29/30

[52] U.S. Cl. ..... 271/193; 198/679; 198/690; 271/DIG. 3

[58] Field of Search ..... 271/193, DIG. 3; 198/690, 679

[56] References Cited

U.S. PATENT DOCUMENTS

| | | | |
|---|---|---|---|
| 2,953,238 | 9/1960 | Buccicone | 271/193 X |
| 3,199,654 | 8/1965 | Buccicone | 198/679 |
| 3,229,805 | 1/1966 | Buccicone | 198/679 |
| 3,385,596 | 5/1968 | Ross | 271/193 |
| 3,942,784 | 3/1976 | Buccicone | 271/193 X |

*Primary Examiner*—Richard A. Schacher
*Attorney, Agent, or Firm*—FitzGibbon, Roehrig, Greenawalt & Gilhooly

[57] ABSTRACT

Apparatus for handling magnetizable sheet material, and especially heavy metal plates, which apparatus comprises an overhead conveyor characterized by a supporting frame structure on which a plurality of magnetic roll or roller assemblies are mounted which roller assemblies include a magnet structure with a core having end extensions on which are rotatably carried sheet contacting and supporting rollers with associated pole extension members which are spaced along and extend radially of the axis of the core and which present a downwardly facing bottom surface area of substantial length extending fore and aft of the rollers and in spaced, confronting relation above the top surface of the material contacting the rollers so as to provide a wide flux path which is effective to draw the material into contact with the rollers, the pole extension members having non-magnetic wing portions enabling the connecting of successive roll assemblies being supported for limited vertical movement so as to afford sufficient flexibility to handle, with a high degree of efficiency, plates presenting an uneven or irregular surface for contact with the roller surface.

9 Claims, 9 Drawing Figures

MAGNETIC SHEET CONVEYOR

BACKGROUND OF THE INVENTION

This invention relates to the handling of sheets of material of the type which respond to magnetic forces and is more particularly concerned with improvements in apparatus which includes magnetic roll or roller means for conveying such sheets in a predetermined path.

In sheet piling equipment, and in other apparatus for handling sheets or plates of magnetizable materials, various arrangements have been developed for conveying the sheets so as to enable them to be dropped onto a pile in a piling operation, or to deliver them to another desired location. One form of conveying arrangements which has been used with a high degree of success, particularly, in sheet fabricating mills and similar locations, comprises endless traveling belts with associated fixed magnet units disposed so as to provide a flux path for holding the sheets against the belt surface and causing the material to travel with the belts. Arrangements of this type are disclosed in U.S. Pat. Nos. 3,199,654, dated Aug. 10, 1965, and 3,229,805, dated Jan. 18, 1966. In most situations, the belt type conveyor arrangement is found to be most efficient and economical in handling the sheets with minimum or no damage to the sheet surfaces which engage the belts. In some situations, a magnetic roll or roller arrangement is preferred for various reasons. However, the roller arrangements heretofore provided have certain disadvantages. The roller contact with the sheet surface is along a relatively narrow rigid line so that there is no flexibility axially of the roller and the flux path is held quite narrow with consequent loss in effectiveness, or a need for greater strength magnets. In many arrangements, particularly, when handling heavy metal plates, big heavy rolls or rollers and high magnetic power is required which greatly increases the cost of operation.

A general object of the present invention is to provide equipment for handling magnetizable sheet material which includes an improved conveyor arrangement having incorporated therein sheet supporting and conveying rollers with associated magnet structures which greatly increase the efficiency of the rollers and render them more versatile in use.

A more specific object of the invention is to provide improved apparatus for handling sheets of magnetizable material which includes an overhead magnetic conveyor means having one or more magnetic roll units adapted to be supported in a flexible chain like arrangement for engaging in supporting and conveying relation sheet material which may have an irregular top surface resulting in a reduction in the area of contact available for engagement with the normally rigid roll surface.

Another object of the invention is to provide in magnetizable metal sheet or plate handling apparatus an improved overhead conveyor comprising one or more roll or roller units having incorporated therein an electromagnet in the form of a coil and a core which constitutes a fixed shaft with extended ends on which wheel-like rollers are rotatably mounted in axially spaced relation so that the periphery thereof travels in a path for engagement with the top surface of the sheet material and the core structure having axially spaced extension members positioned adjacent the sheet contacting rollers which present a downwardly facing surface spaced a small distance from the path of the sheet and extending fore and aft of each of the associated rollers so as to provide a flux path which is of substantially greater width than the corresponding dimension of roll surface in contact with the sheet.

To this end the invention as claimed herein is embodied in sheet handling apparatus in which means is provided for advancing in a predetermined path sheet material of a character which is responsive to magnetic attraction, which apparatus includes one or more rotatably mounted sheet engaging roll members and associated means providing a path for magnetic flux which spreads the flux over an area substantially greater than the area of the roll surface in contact with the material being conveyed.

The foregoing and other objects and advantages of the invention will be best understood when reference is made to the accompanying description of the preferred form of the invention which is set forth herein, by way of example, and shown in the drawings wherein like reference numerals indicate corresponding parts throughout.

DESCRIPTION OF THE PREFERRED EMBODIMENTS OF THE INVENTION

Figure 1:
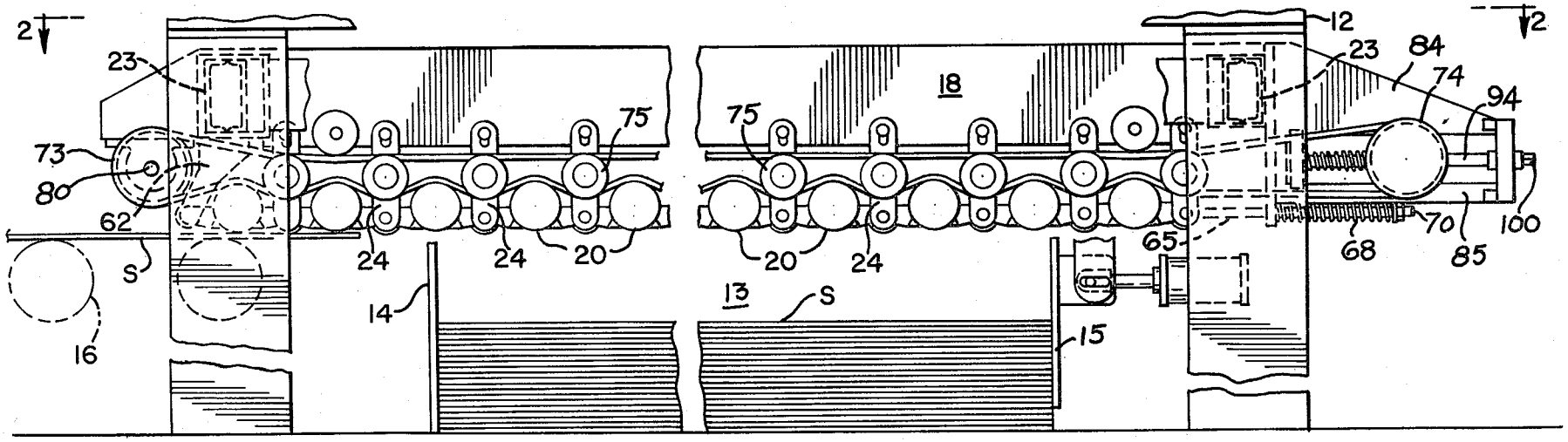
FIG. 1 is a side elevational view, partly schematic, showing a sheet handling and piling arrangement employing an overhead magnetic roll conveyor which embodies the principal features of the invention.
Figure 2:
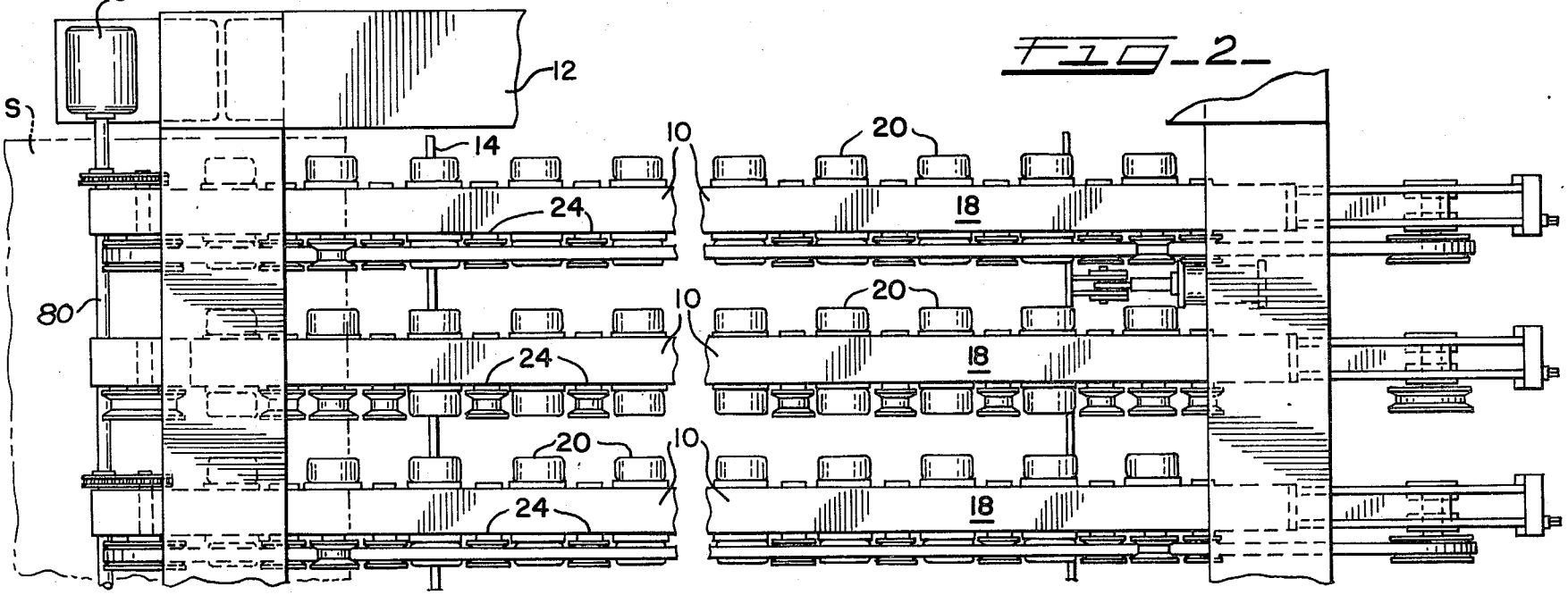
FIG. 2 is a plan view of the sheet handling arrangement shown in FIG. 1, the view being taken on the line 2—2 of FIG. 1.

Referring first to FIGS. 1 and 2 of the drawings, there is illustrated a magnetic sheet piling machine which embodies therein the principal features of the invention. In the form of the piling machine illustrated, three overhead magnetic roller conveyors 10 are supported on an elongate frame structure 12 and extend over a sheet piling area 13 which is defined by a back stop 14 arranged at the entrance end of the machine and an end stop mechanism 15 at the discharge end thereof, the latter being generally adjustable according to the length of the sheets. The sheets S are presented to the entrance end of the conveyors 10 by a sheet supporting and advancing means of any known construction, for example, a driven roller bed indicated at 16.

The conveyors 10, as illustrated, each comprise an elongate support frame 18 (FIG. 3), in the form of a rail, from which a plurality of magnetic roll assemblies or units 20 are suspended so as to depend from the bottom face 22. The rail frame structure 18 is supported on the main frame 12 by cross beams 23 at opposite ends of the frame 12. The roll units 20 are pivotally interconnected like the links in a chain and they are suspended by pairs of link bars 24, 25 (FIGS. 1, 3 and 7) depending from and spaced along the length of the support structure 18 so as to permit substantial flexibility in both a longitudinal and a transverse direction and to enable more efficient handling of sheets which may have an uneven top surface.

Figures 3, 4, 5, 6:
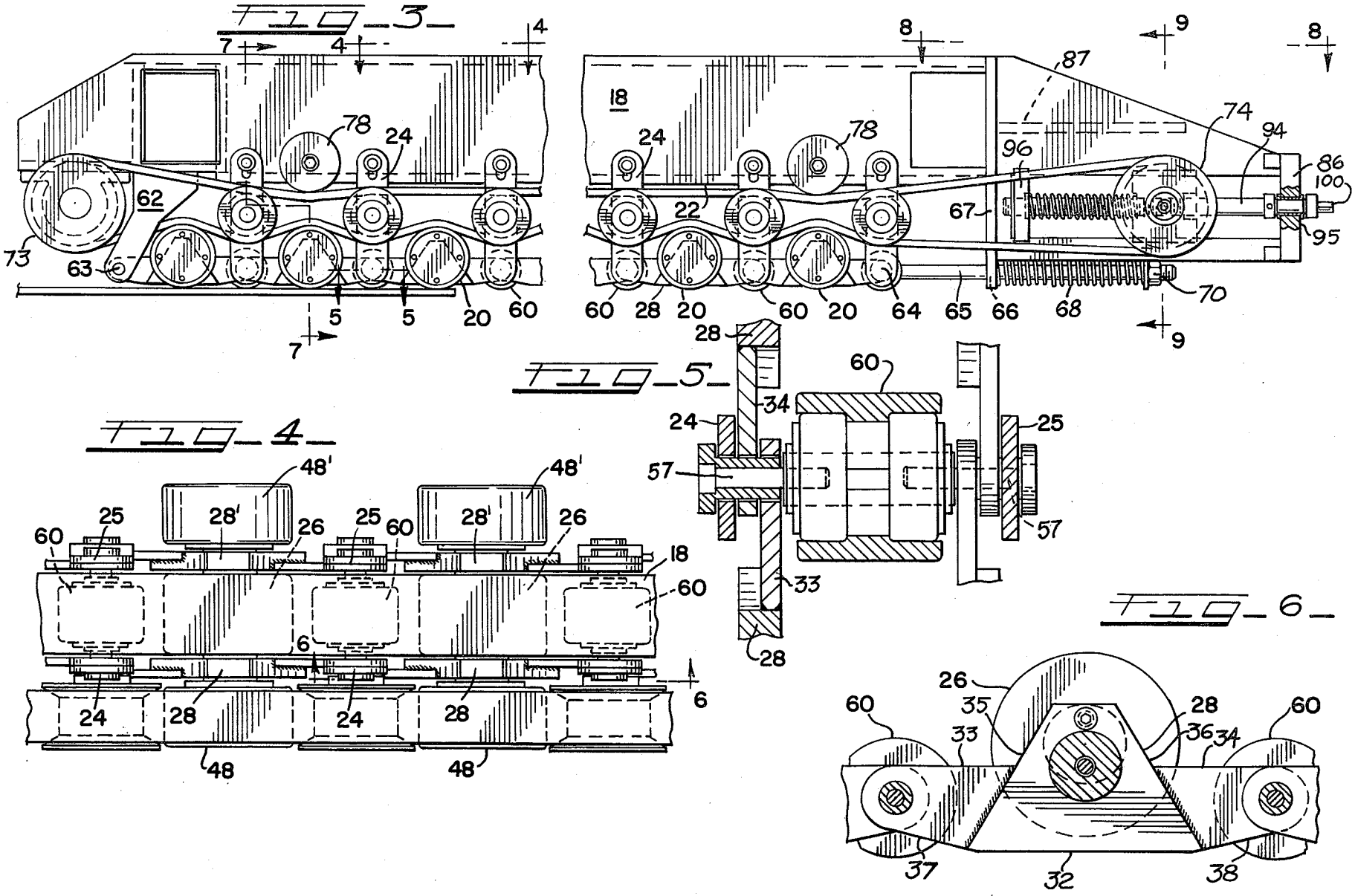
FIG. 3 is a side elevation, to an enlarged scale and with portions broken away, showing the overhead magnetic roll conveyor which is employed in the apparatus illustrated in FIG. 1, the conveyor being shown as the rail unit appears when removed from the apparatus of FIG. 1.
FIG. 4 is a partial plan view of the structure shown in FIG. 3, to an enlarged scale, the view being taken on the line 4—4 of FIG. 3.
FIG. 5 is a cross sectional view taken on the line 5—5 of FIG. 3, to a larger scale.
FIG. 6 is a cross sectional view taken on the line 6—6 of FIG. 4 to a larger scale.

The magnetic assemblies or roll units 20 are of identical construction. Each comprises an electromagnetic coil 26 (FIGS. 4 and 7) and a core 27 which is secured at its ends so as to extend between a pair of core extensions or pole pieces 28, 28' (FIG. 6), which are spaced a very small distance from the ends of the coil 26 and extend in spaced parallel planes normal to the axis of the core 27. Each core extension or pole piece 28, 28' comprises a plate member 30 of substantial width or thickness and having the form of a truncated triangle arranged with a relatively long, generally rectangular bottom edge of substantial width which is facing downwardly and which provides a bottom surface 32 of substantial area. The plate member 30 is fabricated of iron or similar material which will provide a satisfactory flux path. Each plate member 30 has secured thereon wing members 33, 34 which extend in the plane of the plate member from the lower portions of the opposite inclined edges 35 and 36 thereof, with bottom edge surfaces 37, 38 tapered upwardly, fore and aft of the plate member 30, and with apertures 40, 42 in the outer ends. The resultant configuration of the plate assembly 30, 33, 34 is in the form of a chain link enabling coupling of the units in a line as illustrated in the drawings. The wing members 33, 34 are formed of non-magnetic material, for example, stainless steel, so as to confine the magnetic flux to a path which has a width determined by the length of the bottom face 32 of the plate member 30. Stub shafts 43, 43' are of relatively small axial dimension and are secured by bolts 44, or other suitable fastening means, in axially extending relation on the outside or outboard face 45 of the plate members 30. The axes of the shafts 43, 43' are aligned and offset downwardly relative to the axis of the core member 27, as shown in FIG. 6. Roller bearings 46 are held on the outboard ends of the shafts 43, 43' by cap members 47 which are secured by bolt 44 and sheet engaging rollers 48, 48' are rotatably mounted thereon by means of the bearings 46. The rollers 48 and 48' are of identical construction and are mounted in an identical manner. Each roller 48, 48' is recessed in two steps at its outboard face to provide a seat for the bearing 46 and also to receive a plug type closure 50, 50'. The roller body is fabricated of steel and designed to obtain the most efficient use of the magnetic flux available. Likewise, the shafts 43, 43', caps 45, and plugs 50, 50' are of like material for the same reason, that is, to provide an efficient path for the flux. The minimum inside diameter of each of the rolls 48, 48' is such that the gap between the inside roll surface 52, 52' and the confronting shaft surface 53, 53' is very small. Likewise, the axial dimension and configuration is such that the gap at 54, 54' is small. The cap plate 47, 47' and the associated plug 50, 50' are proportioned and disposed relative to each other so that there is only a small gap between them, as indicated at 55 in FIG. 7. The plug 50 serves the dual purpose of helping to retain the bearing 46 in the roll body and also to provide a by-pass for flux which would otherwise go through the bearing 46 and cause friction making the roll 48 harder to turn. The design of the roll parts provide maximum use of the flux and minimizes the friction imposed by the magnetism. The rolls 48, 48' are positioned vertically so that the peripheral surfaces travel in a path extending below the bottom surfaces of the pole pieces 28, 28', that is, the rolls are located relative to the pole pieces 28, 28' so that there is a small gap between the bottommost surfaces and the top surfaces of a sheet which engages the rolls 48, 48'.

Figures 7, 8, 9:
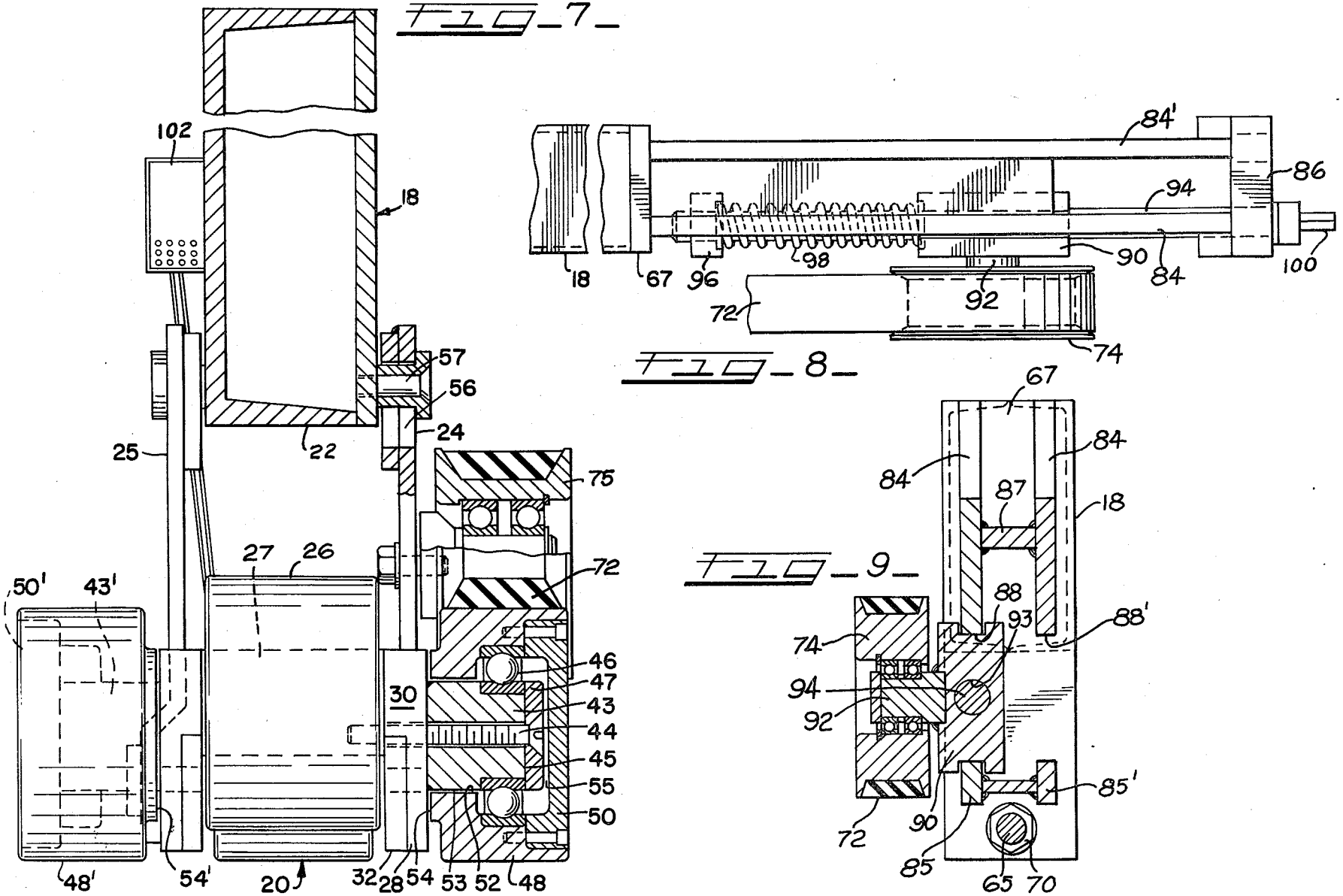
FIG. 7 is a cross sectional view of the magnetic roll conveyor to an enlarged scale, with portions broken away and other portions in section, the view showing the roller and magnet structure and associated mounting arrangement, the section being taken generally on the line 7—7 of FIG. 3.
FIG. 8 is a fragmentary plan view taken on the line 8—8 of FIG. 3, to a larger scale, and with portions broken away.
FIG. 9 is a cross sectional view, taken on the line 9—9 of FIG. 3, to a larger scale.

In the conveyor arrangement illustrated, provision is made for connecting a plurality of the magnetic roll units or assemblies 20 in alignment beneath the support member 18 so as to provide a degree of flexibility in both horizontal and vertical directions, and also for driving the rolls on one side. Each roll unit 20, except for the first one at the entrance end of the machine, is suspended by two pairs of the vertically disposed links, spaced along the length of the support member 18, with each pair of the vertical links serving as a common support for successive roll units 20. As shown in FIG. 7, each of the links 24, 25 has a vertical slot 56 at the top providing for a limited sliding connection with a support pin 57 extending from the support member 18. At the bottom end the links 24, 25 have a pivot pin connection at 58 with the two pole piece extension wing members 33, 34 of the successive roll units 20. The connecting pivot 58, in the form shown, carries a sheet contacting roller 60 which will insure that the sheets do not buckle and contact the pole piece extensions between the magnetic rolls. In some situations where the sheets are sufficiently stiff, these rollers 60 may be omitted.

Provision is made for applying tension longitudinally of the assembly of roll units 20. At the entrance end of the conveyor support member 18 a pair of laterally spaced depending rigid bracket members 62 (FIG. 3) are provided for pivotal connection at 63 with the trailing ends of the pole piece extension members 28, 28'. At the other end of the support member 18 a cross pin 54 extends between the end pair of vertical link members 24, 25 and is connected to the end of an elongate rod 65, which rod 65 extends through an aperture 66, in sliding relation, in the lower end of a vertical frame plate 67. The rod 65 carries a coil spring 68 trapped between the plate 67 and a nut 70 which is threaded on the end of the rod 65 so that it may be adjusted axially of the rod to provide the desired tension in the assembly of units 20.

In the arrangement illustrated, the magnetic rolls 48 on the one side of the two outboard conveyors 10 in FIG. 2 are provided with a driving means while the rolls 48' on the other side of these units are not driven except by contact with a sheet which is passing through the machine. The intermediate conveyor 10 is not provided with a drive for the magnetic rolls on either side. They turn only by contact with the traveling sheets.

The roll drive arrangement, as illustrated, comprises an endless drive belt 72 which is supported at opposite ends of the support frame 18 on end pulleys 73 and 74 (FIG. 3) and travels on a plurality of guide pulleys 75 mounted, in longitudinally spaced relation, intermediate the end pulleys 73, 74, on the vertically disposed supporting link members 24 for the magnetic roll units 20. Each of the drive belt guide pulleys 75 is mounted on a stub shaft 76 (FIG. 7) extending from the supporting link 24 with suitable bearing member 77 so as to provide free rolling of the pulley. Each pulley 75 is positioned vertically at an elevation which will hold the lower run of the drive belt 72 in contact with the magnetic rolls 48 between which the pulley 75 is located or the adjacent roll in the case of the last pulley in the line. A suitable member of guide rolls or pulleys 78 are rotatably mounted near the bottom of the support frame 18 in position to control the path of the top run of the drive belt 72. The belt supporting end pulley 73 at the entrance end of the rail unit 10 is mounted on a drive shaft 80 (FIG. 2) supported in bearing brackets 82 (FIG. 3) depending from the conveyor rail units 10 with a suitable connection to a drive motor 83 supported on the frame 12, or other source of power. The rail unit support frame 18 is extended at the discharge end to provide a tensioning arrangement for the drive belt 72 as shown in FIGS. 1, 2, 3, 7, 8 and 9. Side plate members are longitudinally slotted to provide top and bottom plate portions 84, 85 and 84', 85' extending in parallel, laterally spaced relation from the vertical end plate 67 to a connecting cross plate or bar member 86 which is spaced from the plate 67. Suitable cross bar braces 87 connect the side plate members. The top plate portions or members 84, 84' are vertically spaced above the top edges of the bottom plate members 85, 85' so that the spaced confronting top and bottom edges of plate members 84, 85 and 84', 85' define block receiving tracks 88, 88'. A slidable mounting block 90 is received in track 88 on which the belt end pulley 74 is carried by means of stub shaft 92 which extends laterally outboard of the mounting block 90. The block 90 is provided with top and bottom grooves for cooperation with the track 88 and also with a longitudinal bore 93 for receiving a rod 94. The rod 94 which is in the form of a screw, is secured at one end, in rotatable relation in a bushing 95 in the end cross bar member 86. At the opposite end the rod 94 is threaded in a bore 96 in a traveling nut 97, mounted on the track 88. A spring 98 is carried on the rod 94 between the forward face of the cross plate 94 and the trailing face of the mounting block 90. The rod 94 has a tool receiving end 100 enabling adjustment to vary the tension in the belt 72.

While the arrangement for driving the magnetic rolls 48 is shown on only one side of a conveyor assembly, the magnetic rolls 48' on the other side may be driven by duplicating the drive arrangement on that side of the rail unit. In some situations, for example, when relatively short light weight sheets are being handled, it may not be necessary to provide a positive drive from the magnetic roll or rolls. Forward motion may be imparted to the sheets by driven pinch rolls or similar sheet projecting means sufficient to advance the sheets the desired distance.

The electromagnetic coils may be supplied with current for operation from a suitable supply source and provisions may be made for controlling the actuation or non-actuation of the coils and the strength thereof. A conduit box may be mounted on the support frame 18 as indicated at 102 in FIG. 7 through which power may be supplied from a suitable source. Various arrangements of the rail units are possible depending on the use of the same. In the sheet piler illustrated, provision may be made in a well known manner for adjusting the position of the rails transversely of the machine to most efficiently handle sheets of various sizes and weight. The control of individual coils along the length of the rail unit, of course, permits forming of multiple piles in a piling machine since the actuation of the coils can be timed to drop the sheets in spaced piles.

The present arrangement affords substantial advantages and economy over arrangements heretofore employed. In piling operations, for example, where pinch rolls have been employed to advance sheets or plates, particularly heavy plates, beneath long and heavy metallic rolls of the designs previously developed, lack of adequate control of the advancing sheet due to weak or inefficient magnet power has resulted in damage to the sheet surfaces, the advancing edges of the sheets dropping onto the surface of the previously deposited sheet and resulting in gouging or scratching of the surface. With the present arrangement the energy required to actuate and operate efficiently the sheet carrying rollers and the pole piece members is a fraction of that required for the roller arrangements heretofore available, while enabling control of heavy sheets or plates so as to drop them on the pile or piles without premature dropping of the leading or trailing edges thereby avoiding damage to the plate surfaces and effecting substantial economy in the use of energy.

The present apparatus is particularly adapted for handling heavy rigid plates safely and economically. It enables maintaining constant holding power above the requirements for safety and consumption of electrical energy. The magnetic field is directed onto the plate being advanced beneath the rolls or wheels and there is no dispersion of magnetic power by gaps caused by distorted plate shape. The flexible bed allows the magnetic field and the wheels to follow the plate shape. The wheels are ball bearing mounted for free rolling and enable moving heavy plate forward so as to be piled with little power. By inclining the conveyor, heavy plate will roll forward without power driving the wheels. The capacity of the apparatus to handle heavy plate does not impair its ability to handle flexible, light material and, accordingly, the range of the equipment is increased.

I claim:

1. Conveying apparatus for magnetizable sheet material which comprises an elongate supporting frame member having mounted thereon magnetic roll units, each of which includes a coil having a core extending transversely of the frame member and secured between a pair of pole pieces in the form of plate members of substantial thickness which are disposed in fixed relation in generally parallel vertical planes on opposite ends of said core, said pole pieces being arranged so as to provide corresponding bottom edge surfaces of substantial dimension extending in a direction normal to the axis of the core, said bottom edge surfaces defining a relatively wide magnetic flux path extending between the pair thereof and transversely of said frame member, short shaft forming members of magnetizable material secured on outboard faces of said pole pieces with their axes extending transversely of said frame and roll members of magnetizable material rotatably mounted on said shaft members, adjacent the outboard faces of said pole pieces, means for driving said roll members, said roll members having peripheral surfaces of substantial width rotating in a vertical plane so that a sheet is drawn into engagement with them and advanced in a predetermined generally horizontal path which is spaced only a short distance below the pole piece bottom surfaces and in said wide magnetic flux path.

2. A magnetic roll type conveyor for magnetizable sheet material which comprises an elongate support frame and a plurality of magnetic roll assemblies mounted on said frame in depending relation, each said roll assembly including a magnet coil with a core member extending transversely of said support frame, pole pieces secured in fixed relation on opposite ends of said core member which are in the form of vertically disposed plates of magnetizable material having downwardly facing bottom edge surfaces of substantial width and extending a substantial distance in the direction normal to the axis of the core member so as to provide a relatively wide magnetic flux path extending between said surfaces and transversely of said support frame, shaft forming members of magnetizable material secured on the outboard faces of said pole pieces with the axes thereof aligned transversely of said support frame and sheet carrying roll members of magnetizable material rotatably mounted on said shafts which are dimensioned and positioned relative to the downwardly facing surfaces of said pole pieces so that their rotating peripheral surfaces will engage the sheets and cooperate with said pole pieces in supporting the sheets for travel in a path a short vertical distance from the bottom edge surfaces of said pole pieces and intersecting the magnetic flux path extending between said bottom edge surfaces.

3. A magnetic roll type conveyor for magnetizable sheet material which comprises a support frame and a plurality of magnetic roll assemblies mounted for support on said frame in depending relation, each said roll assembly including a magnet coil with a core member extending transversely of said support frame, pole pieces on opposite ends of said core member which are in the form of vertically disposed plates of magnetizable material arranged to present downwardly facing surfaces of substantial dimension in the direction normal to the axis of the core member so as to provide a relatively wide flux path between said surfaces, shaft forming members of magnetizable material secured on the outboard faces of said pole pieces with the axes thereof aligned transversely of said support frame, sheet carrying roll members of magnetizable material rotatably mounted on said shafts which are dimensioned and positioned relative to the downwardly facing surfaces of said pole pieces so that their rotating peripheral surfaces will engage and support sheets for travel in a path a short vertical distance from said pole piece surfaces, and said pole pieces having wing members of non-magnetic material extending in the plane of said pole pieces and fore and aft of the sheet engaging surfaces of said roll members, which wing members cooperate with said pole pieces in providing a chain link arrangement for connecting and supporting the roll assemblies.

4. A magnetic roll type conveyor as set forth in claim 3 wherein said roll assemblies are mounted on said support frame by means of vertically disposed link bars connected at the top end in pivotal and slidable relation with a portion of said support frame and pivotally connected at the bottom end with said pole piece wing members.

5. A magnetic roll type conveyor for magnetizable sheet material which comprises a support frame and a plurality of magnetic roll assemblies mounted for support on said frame in depending relation, each said roll assembly including a magnet coil with a core member extending transversely of said support frame, pole pieces on opposite ends of said core member which are in the form of vertically disposed plates of magnetizable material arranged to present downwardly facing surfaces of substantial dimension in the direction normal to the axis of the core member so as to provide a relatively wide flux path between said surfaces, shaft forming members of magnetizable material secured on the outboard faces of said pole pieces with the axes thereof aligned transversely of said support frame, sheet carrying roll members of magnetizable material rotatably mounted on said shafts which are dimensioned and positioned relative to the downwardly facing surfaces of said pole pieces so that their rotating peripheral surfaces will engage and support sheets for travel in a path a short vertical distance from said pole piece surfaces, said pole pieces having wing members of non-magnetic material which extend fore and aft of said sheet carrying roll members, and pivotal means connecting wing members of adjoining roll assemblies so as to provide a chain-like arrangement thereof.

6. A magnetic roll type conveyor for magnetizable sheet material which comprises a support frame and a plurality of magnetic roll assemblies mounted for support on said frame in depending relation, each said roll assembly including a magnet coil with a core extending transversely of said support frame, pole pieces on opposite ends of said core member which are in the form of vertically disposed plates of magnetizable material arranged to present downwardly facing surfaces of substantial dimension in the direction normal to the axis of the core member so as to provide a relatively wide flux path between said surfaces, shaft forming members of magnetizable material secured on the outboard faces of said pole pieces with the axes thereof aligned transversely of said support frame, sheet carrying roll members of magnetizable material rotatably mounted on said shafts which are dimensioned and positioned relative to the downwardly facing surfaces of said pole pieces so that their rotating peripheral surfaces will engage and support sheets for travel in a path a short vertical distance from said pole piece surfaces, said pole pieces having wing members extending fore and aft of the associated sheet carrying roll members, and pivot means connecting the wing members of adjoining roll assemblies and the lower ends of link support members, which link support members are pivotally connected at their upper ends to said support frame.

7. In a conveyor for magnetizable sheet material which comprises a support frame and a magnetic roll assembly for supporting and advancing the sheet material which is carried on said support frame in depending relation, said magnetic roll assembly including a magnet coil with a core member extending in fixed relation transversely of said support frame, pole pieces carried in fixed relation on opposite ends of said core member which are in the form of vertically disposed plate members of magnetizable material and which are constructed and arranged to present downwardly facing surfaces of substantial dimension extending in the direction normal to the axis of the core member so as to provide a relatively wide flux path extending between the downwardly facing surfaces of said plate members and transversely of said support frame, shaft forming members secured on said plate members with the axes thereof aligned transversely of said support frame and extending outboard of said plate members, sheet engaging magnetic roll members rotatably mounted on said shafts which are dimensioned and positioned relative to the downwardly facing surfaces of said plate members so that the rotating peripheral surfaces of said magnetic roll members will engage and support sheets for travel in a path spaced a short distance from said downwardly facing surfaces of said plate members and within the magnetic flux path area between said surfaces.

8. In a magnetic roll type conveyor for magnetizable sheet material which comprises a support frame and a magnetic roll assembly mounted in depending relation on said support frame, said roll assembly including a magnet coil and a core member extending transversely of said support frame, pole pieces mounted on opposite ends of said core member which comprise vertically disposed plate members of magnetizable material having downwardly facing surfaces of a dimension which is substantially greater than the dimension of the core member in the direction normal to the axis of the core member and extending fore and aft of said core member so as to provide a relatively wide magnetic flux path extending between said downwardly facing surfaces and transversely of said support frame, shaft forming members secured on the outboard faces of said plate members with the axes thereof aligned transversely of said support frame, and sheet engaging magnetic roll members rotatably mounted on said shafts which are dimensioned and positioned relative to the downwardly facing surfaces of said plate members so that the rotating peripheral surfaces of said magnetic roll members will engage the sheets and in cooperation with the plate members support the sheets so that they travel in a path spaced a short distance from said downwardly facing surfaces of said plate members and extending through the transverse flux path in the area between said plate members.

9. In a magnetic roll type conveyor as set forth in claim 8 wherein said downwardly facing surfaces of said plate members extend fore and aft of the sheet engaging surfaces of said magnetic roll members and have a dimension in the direction fore and aft of said sheet engaging surfaces of said magnetic roll members which is substantially greater than the dimension of said sheet engaging surfaces in the corresponding direction.

* * * * *

UNITED STATES PATENT AND TRADEMARK OFFICE

CERTIFICATE OF CORRECTION

PATENT NO. : 4,180,257

DATED : December 25, 1979

INVENTOR(S) : Dario Buccicone

It is certified that error appears in the above—identified patent and that said Letters Patent is hereby corrected as shown below:

Column 4, line 47 -- cross pin 54, should be cross pin 64;

Column 6, line 11-12 -- "metallic" should be -- magnetic --;

Signed and Sealed this

*Twenty-fourth* Day of *June 1980*

[SEAL]

*Attest:*

SIDNEY A. DIAMOND

*Attesting Officer*

*Commissioner of Patents and Trademarks*